US005961216A

United States Patent [19]

Quinn et al.

[11] Patent Number: 5,961,216

[45] Date of Patent: Oct. 5, 1999

[54] DIAPER ORGANIZER BAG

[76] Inventors: Cassie Quinn; Robie Quinn, both of 11724 E. Nora, Spokane, Wash. 99206

[21] Appl. No.: 09/152,773

[22] Filed: Sep. 12, 1998

Related U.S. Application Data

[60] Provisional application No. 60/058,686, Sep. 12, 1997.

[51] Int. Cl.[6] ..... B65D 30/00

[52] U.S. Cl. ..... 383/4; 190/2; 206/581; 220/528; 383/38; 383/40

[58] Field of Search ..... 383/4, 38, 40; 190/1, 2, 6, 33; 206/581, 444; 220/503, 523, 528, 558

[56] References Cited

U.S. PATENT DOCUMENTS

| | | | |
|---|---|---|---|
| 1,089,939 | 3/1914 | Mazwell . | |
| 1,355,647 | 10/1920 | Breakstone | 220/503 |
| 1,481,194 | 1/1924 | Fischer | 220/503 |
| 1,927,624 | 9/1933 | Appel . | |
| 2,130,502 | 10/1938 | Lindemann . | |
| 2,331,428 | 10/1943 | Selezneff . | |
| 2,843,170 | 7/1958 | Frankfurt | 383/38 X |
| 2,844,141 | 7/1958 | Daugherty . | |
| 2,904,091 | 9/1959 | Reed . | |
| 2,937,680 | 5/1960 | Dumas | 150/35 |
| 2,988,125 | 6/1961 | Reynolds | 150/32 |
| 3,038,513 | 6/1962 | Hamlett | 383/38 X |
| 3,164,187 | 1/1965 | Simmons | 383/38 X |
| 3,335,775 | 8/1967 | Adams | 150/30 |
| 3,347,346 | 10/1967 | Young | 190/1 X |
| 3,759,356 | 9/1973 | Bostic | 190/42 |
| 3,874,435 | 4/1975 | Allen | 383/40 X |
| 4,154,323 | 5/1979 | Sneider | 383/40 X |
| 4,236,559 | 12/1980 | Archbold | 383/38 X |
| 4,273,221 | 6/1981 | Poag | 190/1 X |
| 4,566,130 | 1/1986 | Coates | 383/15 |
| 4,574,822 | 3/1986 | Helinsley | 132/79 R |
| 4,685,559 | 8/1987 | Titus | 206/38 |
| 4,706,845 | 11/1987 | Schnurer | 221/102 |
| 4,781,277 | 11/1988 | Linn | 190/1 |
| 4,893,722 | 1/1990 | JOnes | 220/503 |
| 5,050,998 | 9/1991 | Wachtel | 383/40 X |
| 5,070,973 | 12/1991 | Barnicoat | 383/4 X |
| 5,129,543 | 7/1992 | White | 220/503 |
| 5,219,090 | 6/1993 | Vollman | 220/523 X |
| 5,439,154 | 8/1995 | Delligatti | 224/205 |
| 5,743,649 | 4/1998 | Gonzales | 383/6 |
| 5,785,219 | 7/1998 | Kraft | 383/4 X |
| 5,816,433 | 10/1998 | Higgins | 220/503 X |

FOREIGN PATENT DOCUMENTS

| | | | |
|---|---|---|---|
| 2077095 | 12/1981 | United Kingdom | 383/38 |

*Primary Examiner*—Allan N. Shoap
*Assistant Examiner*—Robin A. Hylton
*Attorney, Agent, or Firm*—David S. Thompson

[57] ABSTRACT

A diaper organizer bag 10 provides an enclosure 30 having opposed side panels, a back panel, and a bottom panel, and defines front and rear cavities between a lengthwise divider. A changing pad 60 is movable between a raised position wherein it forms a front panel of the enclosure to a lowered position, wherein it forms a soft, cleanable surface for changing a baby. A flap 70 is attached to an upper edge of the back panel, and in a travel position covers the top and front of the enclosure. In a use position, the flap may be folded back to provide access to the top and front of the enclosure. At least one separating panel 90 is provided to compartmentalize the rear cavity defined within the enclosure in a variable manner, thereby forming small or large storage areas within the rear cavity, as needed. A drawer assembly 180 is carried within the front cavity of the enclosure, and is accessible when the flap is in the use position. When desired, the entire drawer assembly may be removed, allowing the front cavity to be used for the storage of additional larger items.

2 Claims, 3 Drawing Sheets

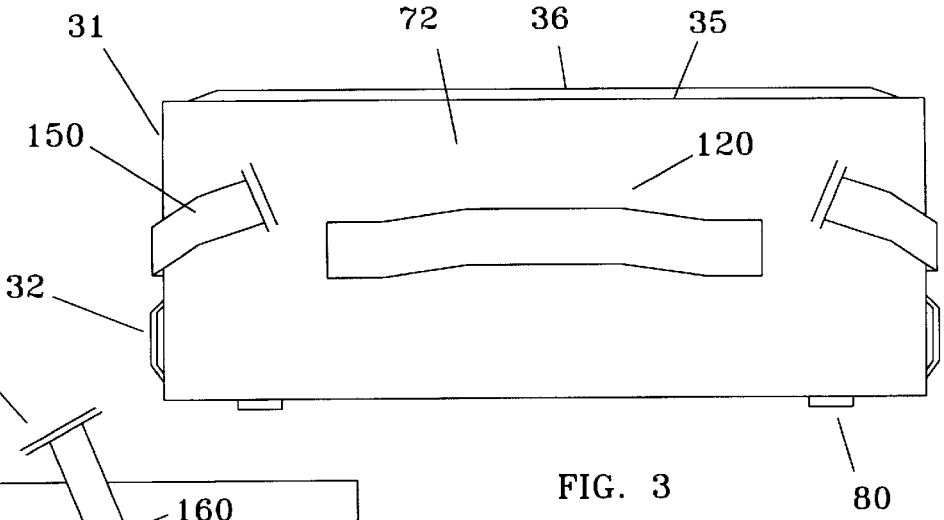
FIG. 3
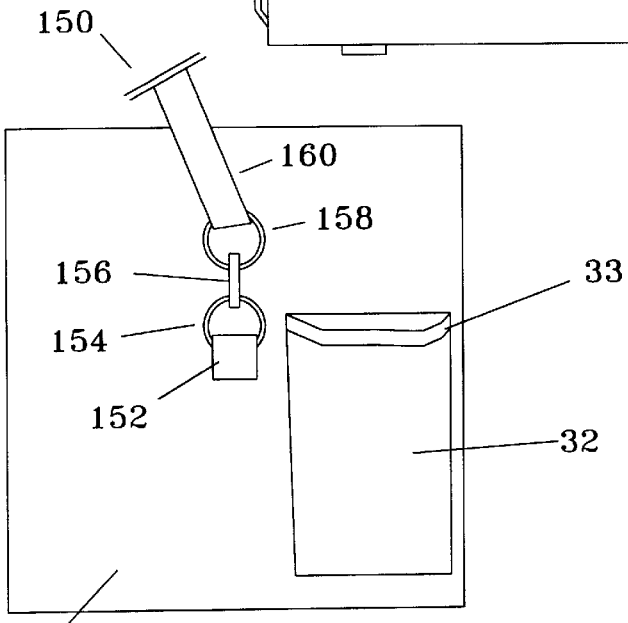
FIG. 4
FIG. 5
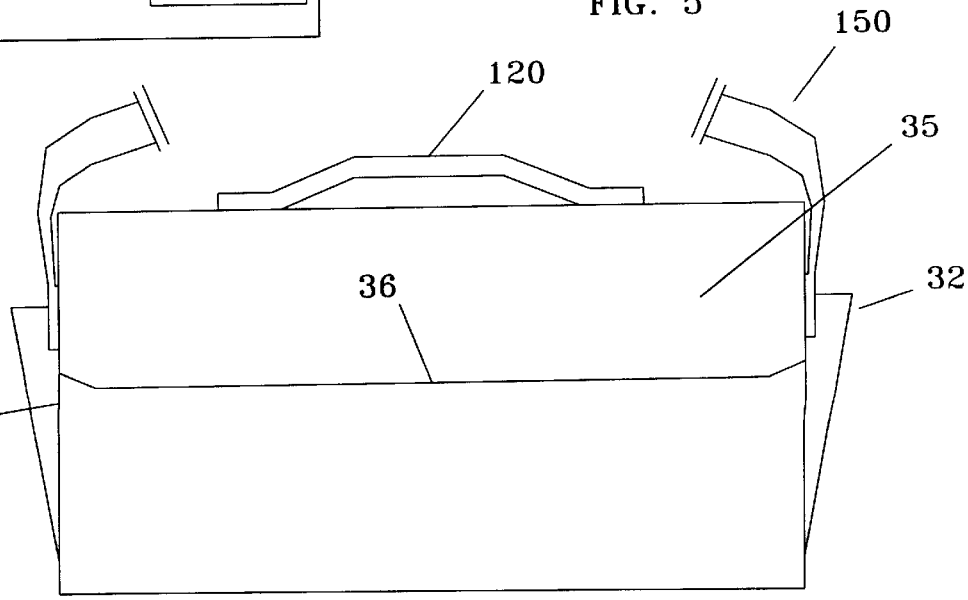

DIAPER ORGANIZER BAG

CROSS-REFERENCES

This application is a continuation of a provisional application filed Sep. 12, 1997, having Ser. No. 60/058,686.

BACKGROUND

A number of diaper bags are known. Most attempt to address the issue of carrying the numerous items that may assist in the diaper changing process. However, the increasing number of disposable items sold for child care has complicated matters, and as a result parents look for progressively more flexible bags, able to carry a particular desired mix of products. As a result, a number of bags have been developed, each having a different structure addressing the similar problems. However, no one bag is viewed by the public as a single solution to the problem of storage and transport of diapers and accessories.

The primary problem with most diaper bags is the lack of flexibility; i.e. a lack of the ability to change the number, size and configuration of the storage compartments available in a given diaper bag.

For the foregoing reasons, there is a need for diaper organizer bag that provides a number of compartments that are easily accessed, particularly having separating panels which allow the compartments to be sized appropriately, and also having a drawer system that allows a parent to store a large number of small items in a organized manner.

SUMMARY

The present invention is directed to a diaper organizer bag that satisfies the above needs. The diaper organizer bag of the present invention provides some or all of the following structures.

(A) An enclosure, having bottom, back and opposed side panels, is compartmentalized by a lengthwise divider, thereby defining front and rear cavities. In a preferred version of the enclosure, the back and opposed side panels carry pockets for storage and transport of small items such as a baby's bottle.

(B) A changing pad folds along a front edge of the bottom panel, from a raised to a lowered position. In the raised position, side edges of changing pad are releasably attached to the front edges of the opposed side panels. In the raised position, the changing pad forms a front panel of the enclosure. In the lowered position, the changing pad provides a padded horizontal surface.

(C) A flap, attached to an upper edge of the back panel of the enclosure, is sized to fold over and cover the top and front of the enclosure. In a travel position, the flap covers the top and front of the enclosure. In a use position, the flap opens to reveal the top and front of the enclosure. In a preferred version, the flap carries a plurality of zippered pockets for storage of small items.

(D) At least one separating panel is carried within the rear cavity of the enclosure, for compartmentalizing the rear cavity into at least two smaller regions of variable size. Each separating panel provides a first edge releasably attached to an inside surface of the back panel of the enclosure and a second edge releasably attached to a rear surface of the lengthwise divider.

(E) A drawer assembly, carried within the front cavity of the enclosure, for the organized storage of numerous small items. A preferred version of the drawer assembly provides two rows of drawers, each drawer movable from a retracted storage position, wherein the contents of the drawer are prevented from spilling, to an extended position wherein the contents of the drawer are accessible. The entire drawer assembly is removable, thereby increasing the storage space for larger items.

It is therefore a primary advantage of the present invention to provide a novel diaper bag organizer having a drawer assembly having a plurality of drawers for storage of small items in an organized manner. The drawer assembly is removable, thereby providing additional room for larger items.

Another advantage of the present invention is to provide a novel diaper bag organizer having at least one separating panel for adjustable compartmentalizing a rear cavity defined within the enclosure of the diaper bag into at least two regions of variable size.

A still further advantage of the present invention is to provide a novel diaper bag organizer having a fold-down changing pad having side edges which may be attached to the front edges of each of two opposed side panels, thereby forming the front panel of the enclosure of the diaper bag when not in use.

DRAWINGS

These and other features, aspects, and advantages of the present invention will become better understood with regard to the following description, appended claims, and accompanying drawings where:

FIG. 3 is a top view of the diaper organizer bag of FIG. 1, having the flap and changing pad in the closed positions.

FIG. 4 is a side view of the diaper organizer bag of FIG. 3.

FIG. 5 is a back view of the diaper organizer bag of FIG. 3.

DESCRIPTION

Figure 1:
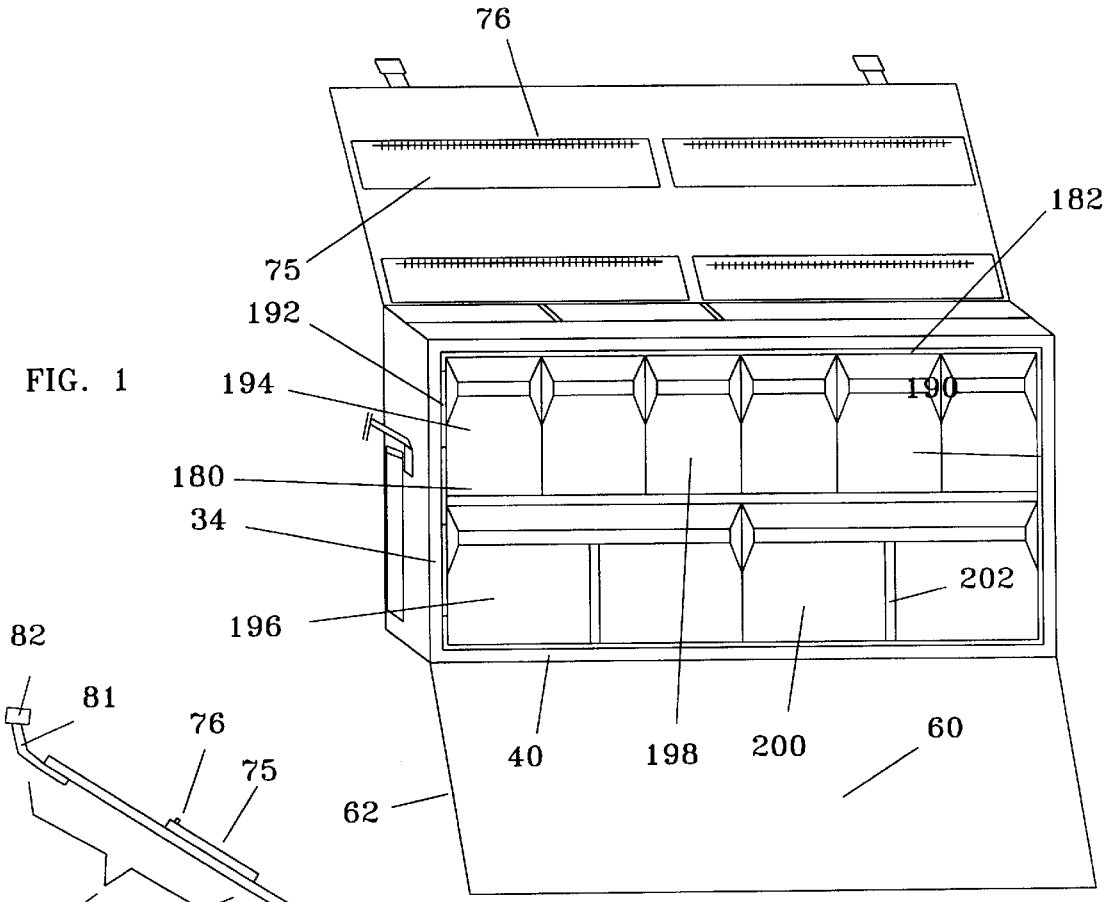
FIG. 1 is a perspective view of a version of the diaper organizer bag of the invention, having the flap fully opened and the changing pad fully lowered, thereby revealing the drawer assembly.

Referring in generally to FIGS. 1 through 7, a diaper organizer bag 10 constructed in accordance with the principles of the invention is seen. The diaper organizer bag provides an enclosure 30 having opposed side panels, a back panel, and a bottom panel, and defines front and rear cavities between a lengthwise divider. A changing pad 60 is movable between a raised position wherein it forms a front panel of the enclosure, to a lowered position, wherein it forms a soft, cleanable surface for changing a baby. A flap 70 is attached to an upper edge of the back panel, and in a travel position covers the top and front of the enclosure. In a use position, the flap may be folded back to provide access to the top and front of the enclosure. At least one separating panel 90 is provided to compartmentalize the rear cavity defined within the enclosure in an adjustable manner, thereby forming small or large storage areas within the rear cavity, as needed. A drawer assembly 180 is carried within the front cavity of the enclosure, and is accessible when the flap is in the use position. When desired, the entire drawer assembly may be removed, allowing the front cavity to be used for the storage of additional larger items.

An enclosure 30, provides a bottom panel 39, a back panel 35 and opposed side panels 31. The interior of the enclosure is compartmentalized by a lengthwise divider 41, thereby defining front and rear cavities 43, 44. The lengthwise divider is parallel to the back panel, and perpendicular to the bottom and side panels.

Figure 2:
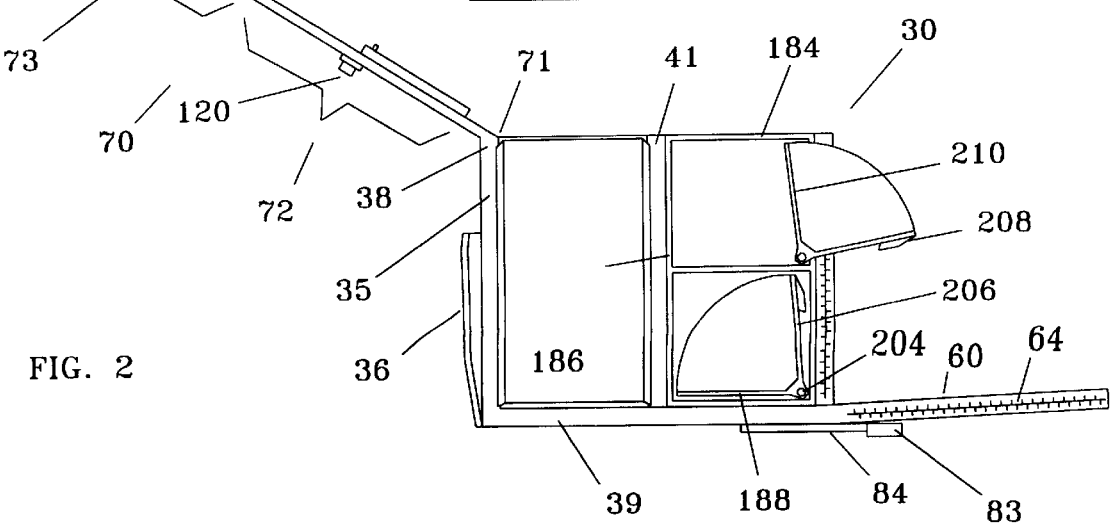
FIG. 2 is a side cross-sectional view of the diaper organizer bag of FIG. 1, showing the flap in a fully open position and the changing pad in the fully lowered position. A separating panel is seen dividing the rear cavity into smaller compartments, and a drawer in the upper row of drawers in the drawer assembly is shown tipped into the open position.

As seen in FIGS. 2 and 5, in a preferred version of the enclosure, the back panel 35 carries a pocket 36. This pocket is typically formed by the addition of an additional layer of the same type of external fabric used in the construction of the back panel. For example, where the back panel is constructed of nylon fabric over foam or polyester filling, an additional layer of nylon fabric may be used to form the pocket 36.

Referring particularly to FIG. 4, the opposed side panels 31 carry somewhat vertically elongated pockets 32. In a preferred embodiment, these pockets 32 are sized for the upright support of a baby's bottle. An elastic closure 33 may be provided to constrain the opening of the pocket.

Figure 6:
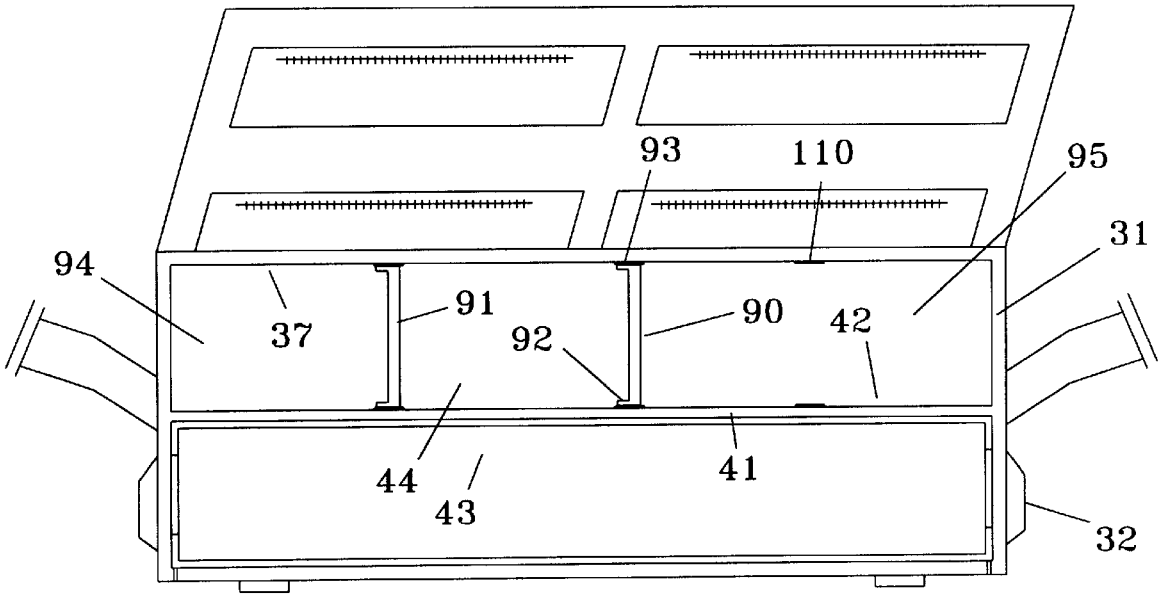
FIG. 6 is a top view the diaper organizer bag, having the flap open, thereby revealing the top of the drawer assembly enclosure and the rear cavity, divided into three compartments by two separating panels.
Figure 7:
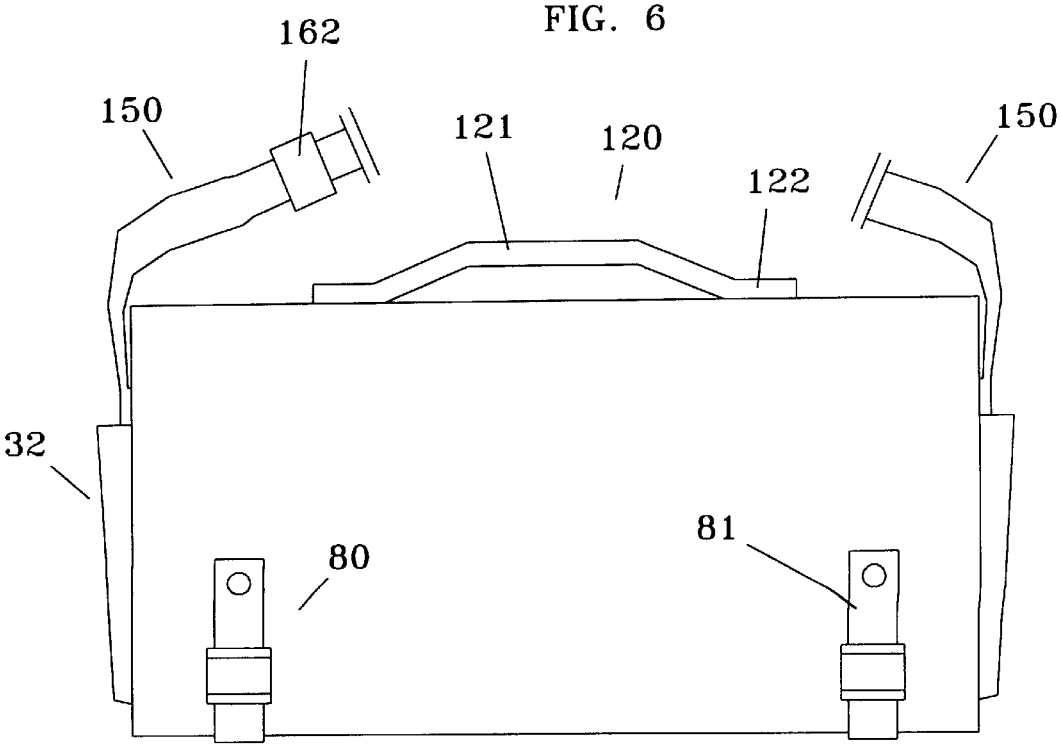
FIG. 7 is a front view of the diaper organizer bag of FIG. 3.

A changing pad 60 folds along a front edge 40 of the bottom panel 39, from a raised to a lowered position. The raised position is seen in FIGS. 3, 6 and 7, while the lowered position is seen in FIGS. 1 and 2. In the raised position, side edges 62 of changing pad 60 are releasably attached to the front edges 34 of the opposed side panels 31. A zipper, VELCRO(R), or other fastener may be used. A zipper 64 is best illustrated in FIG. 2.

As seen in FIGS. 3 and 4, in the raised position, the changing pad forms a front panel of the enclosure, thereby contributing to the formation of the front cavity 43. When oriented to form a front panel, the changing pad tends to protect the drawer assembly 180, and to prevent the drawers from opening.

As seen in FIGS. 1 and 2, in the lowered position, the changing pad provides a padded horizontal surface. This surface is particularly useful to provide a soft, padded and easily cleaned location to change a baby.

A flap 70, attached to an upper edge 38 of the back panel 35 of the enclosure 30 at fold 71. A preferred version of the flap is sized to fold over and form the top 72 and front 73 of the enclosure in the travel or closed position.

In a travel position, seen in FIGS. 4 and 7, the flap 70 covers the top and front of the enclosure. Referring to FIG. 2, the top portion 72 of the flap covers the top of the enclosure, while the front portion 73 of the flap covers the changing pad and front of the enclosure. The front of the drawer assembly 180 is therefore covered by the changing pad 60 and the front portion 73 of the flap 70 in the travel position.

As seen in FIGS. 1 and 2, in a use position, the flap 70 opens to reveal the top and front of the enclosure.

In a preferred version, the flap 70 carries a plurality of pockets 74 having a zipper 75 or other closure device. Such pockets are ideal for the storage of small items, and may be made of a see-through mesh material that reduces the time spent looking for particular items. As seen in FIG. 1, the pockets in a preferred version of the flap are oriented so that when the flap is in the closed (travel) position, the pockets are carried above the rear cavity and adjacent to the upper row 194 of drawers. If pockets were carried above the top 184 of the drawer assembly 180, they would tend to bulge somewhat.

The panels 31, 35, 39, the changing pad 60 and the flap 70 may be made of any desired material, such as a quilted fabric typically with polyester or similar filling, a nylon-type fabric covering with foam, polyester or similar filling, or plastic and other synthetic sheet materials.

As may be understood in particular by viewing FIGS. 2 and 7, a pair of restraints 80 releasably lock a lower portion of the flap 70 to a forward portion of the bottom panel 39 of the enclosure. While the structure is variable, a preferred restraint includes a strap 81, having a first end sewn or otherwise attached to the lower portion of the flap. A second end of the strap carries a fastener element 82 which is releasably attachable to a mating fastening element 83. The fastening element 83 is carried by a first end of strap 84, itself having a second end sewn or otherwise fastened to the bottom panel 39.

As seen in FIG. 7, a handle 120 is attached to the top portion 72 of the flap 70 which covers the top of the enclosure. A preferred handle includes a padded grip 121 attached at opposed ends 122 to the top portion 73 of the flap 70.

As seen in FIGS. 3, 4 and 5, a shoulder strap 150 is attached to the opposed side panels 31 of the enclosure, and allows the diaper organizer bag to be carried with less effort. As seen in FIG. 4, a preferred shoulder strap is removable, thereby allowing a user to minimize the clutter of the bag 10, or to reduce the chance of snagging.

A preferred shoulder strap includes a base 152 attached at a first end to the side panel 31 and at a second end to a ring 154. A snap 156 is releasably attached to a second ring 158 carried by strap 160. An adjustment bracket 162 allows control over the degree to which the strap overlaps itself, and therefore its length.

As an alternative to, or in addition to, the shoulder strap, a pair of straps may be added to allow for carrying as a back back.

At least one separating panel 90 is carried within the rear cavity 44 of the enclosure 30, for compartmentalizing the rear cavity into at least two smaller regions of variable size. Depending on the positioning, the separating panels may create one or more smaller storage areas 94 or a larger storage area 95.

Each separating panel 90 provides a padded body 91 having opposed vertically oriented edges 92 for attachment to the walls defining the rear cavity. The distance between edges 92 is slightly greater than the distance between the inside surface 37 of the back panel to the rear surface 42 of the lengthwise divider. In a preferred embodiment of the invention, the vertically oriented edges 92 carry a covering of male VELCRO(R) or similar fastening material 93. A similar covering of female VELCRO(R) or similar fastening material 110 is carried by the inside surface 37 of the back panel and the rear surface 42 of the lengthwise divider. Use of female, or loop-type fastening material, on the inside surfaces of the panels of the bag provides a soft interior that will not snag fabric items stored in the bag when the separating panels are removed. In some circumstances, where the fabric used to form the panels of the enclosure of the bag are sufficiently durable, no female fastening material is required; the male fastening material carried by the separating panels simply sticks to the inside surfaces of the panels of the bag.

In use, a first vertically oriented edge 92 is releasably attached to an inside surface 37 of the back panel 35 of the enclosure 30, and a second edge 92 is releasably attached to a rear surface 42 of the lengthwise divider 41. The location of the attachment of the separating panel is selected to result in the storage areas 94, 95 of a desired size.

A drawer assembly 180 is carried within the front cavity 43 of the enclosure, and provides for the organized storage of numerous small items. A preferred version of the drawer assembly provides two rows of drawers, but drawer assemblies having a greater or lesser number of rows are also possible. In the preferred version, the upper row 194 includes six narrow upper drawers 198, and the lower row 196 includes two wider lower drawers 200. Each of the lower drawers is divided into two side-by-side compartments by a separating panel 202.

The drawers are supported and enclosed within a drawer enclosure 182, which is removably carried by the front cavity 43 of the enclosure 30 of the diaper organizer bag 10. The drawer enclosure 182 includes a top 184, back 186, bottom 188 and opposed sides 190. The drawer enclosure 182 is typically made of plastic, but alternatively may be made of any desired material. As seen in FIGS. 1 and 6, the sides 190 of the drawer enclosure 182 are attached to the inside surfaces of the opposed side panels 31 by VELCRO (R) or similar fastener 192. When desired, the entire drawer assembly may be removed for use in the bathroom or other area, thereby leaving additional room in the front cavity 43 of the enclosure 30. Additional separating panels 90 may then be used to segment and compartmentalize the front cavity 43.

Each drawer 198, 200 is attached to least one pivot 204, which allows the drawer to tilt or pivot between a closed position and an open position. Referring to FIG. 2, an upper drawer 198 is tilted into the open position and a lower drawer 200 is retracted into the closed position.

In a preferred embodiment, each drawer 198, 200 typically provides a drawer front 206 having a handle 208 and a back surface 210. In an alternative embodiment, each drawer may be of box-type, sliding rather than pivoting within the drawer enclosure 182.

Referring to FIG. 1, it is seen that the diaper organizer bag 10 has left and right sides, each side having three narrow upper drawers 198 and a single wide divided lower drawer 200, and therefore provides a plane of symmetry dividing these sides. As a result, a half-size version of the invention could be provided, having half the number of drawers and pockets 74 in the flap 70.

The previously described versions of the present invention have many advantages, including a primary advantage of providing a novel diaper bag organizer having a drawer assembly having a plurality of drawers for storage of small items in an organized manner. The drawer assembly is removable, thereby providing additional room for larger items.

Another advantage of the present invention is to provide a novel diaper bag organizer having at least one separating panel for adjustably compartmentalizing a rear cavity defined within the enclosure of the diaper bag into at least two regions of variable size.

A still further advantage of the present invention is to provide a novel diaper bag organizer having a fold-down changing pad having side edges which may be attached to the front edges of each of two opposed side panels, thereby forming the front panel of the enclosure of the diaper bag when not in use.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while two rows of drawers are carried within the drawer enclosure 182 of the preferred embodiment, a different configuration of drawers could alternatively be used. Similarly, while pivoting drawers are preferred, sliding drawers could alternatively be used. Therefore, the spirit and scope of the appended claims should not be limited to the description of the preferred versions disclosed.

In compliance with the U.S. patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A diaper organizer bag, comprising:

(A) an enclosure, having bottom, back and opposed side panels, an interior compartment of the enclosure compartmentalized by a lengthwise divider, thereby defining front and rear cavities;

(B) a changing pad carried by a front edge of the bottom panel, is movable from a raised position wherein the side edges of the changing pad are releasably attached to front edges of the opposed side panels and wherein the changing pad forms a front panel of the enclosure, to a lowered position wherein the changing pad provides a padded horizontal surface;

(C) a flap, attached to an upper edge of the back panel of the enclosure, is sized to fold over and cover the top and front of the enclosure, and is movable between a travel position wherein the flap covers the top and front of the enclosure, and a use position wherein the flap opens to reveal the top and front of the enclosure;

(D) at least one separating panel means, carried within the rear cavity of the enclosure, for compartmentalizing the rear cavity into at least two smaller regions of variable size, wherein each at least one separating panel means provides a first edge releasably attached to an inside surface of the back panel of the enclosure and a second edge releasably attached to a rear surface of the lengthwise divider; and (E) drawer assembly means, carried within the front cavity of the enclosure, for the organized storage of numerous small items, comprising at least one drawer movable from a retracted storage position, wherein the contents of the drawer are prevented from spilling, to an extended position wherein the contents of the drawer are accessible.

2. A diaper organizer bag, comprising:

(A) an enclosure, having bottom, back and opposed side panels, an interior compartment of the enclosure compartmentalized by a lengthwise divider, thereby defining front and rear cavities, the back and opposed side panels carrying pockets for storage and transport of small items;

(B) a changing pad carried by a front edge of the bottom panel, is movable from a raised position wherein the side edges of the changing pad are releasably attached to front edges of the opposed side panels and wherein the changing pad forms a front panel of the enclosure, to a lowered position wherein the changing pad provides a padded horizontal surface;

(C) a flap, attached to an upper edge of the back panel of the enclosure, is sized to fold over and cover the top and front of the enclosure, and is movable between a travel position wherein the flap covers the top and front of the enclosure, and a use position wherein the flap opens to reveal the top and front of the enclosure, an inside surface of the flap carrying at least one zippered pocket for storage of small items above the rear cavity when the flap is in the travel position;

(D) two separating panel means, carried within the rear cavity of the enclosure, for compartmentalizing the rear cavity into at least three smaller regions of variable size, wherein each separating panel means provides a first edge releasably attached to an inside surface of the back panel of the enclosure and a second edge releasably attached to a rear surface of the lengthwise divider; and (E) drawer assembly means, carried within the front cavity of the enclosure, for the organized storage of numerous small items, comprising two rows of drawers, each drawer movable from a retracted storage position, wherein the contents of the drawer are prevented from spilling, to an extended position wherein the contents of the drawer are accessible.

* * * * *